US006079946A

United States Patent [19]

Suenaga et al.

[11] Patent Number: 6,079,946

[45] Date of Patent: Jun. 27, 2000

[54] GAS TURBINE BLADE

[75] Inventors: Kiyoshi Suenaga; Sunao Aoki; Kazuo Uematsu, all of Takasago, Japan

[73] Assignee: Mitsubishi Heavy Industries, Ltd., Tokyo, Japan

[21] Appl. No.: 09/044,746

[22] Filed: Mar. 19, 1998

[51] Int. Cl.[7] ..... F01D 5/18

[52] U.S. Cl. ..... 416/97 R; 416/96 R; 415/114

[58] Field of Search ..... 415/114, 115, 415/116, 117; 416/95, 96 R, 964, 97 R; 60/34.75

[56] References Cited

U.S. PATENT DOCUMENTS

| | | | |
|---|---|---|---|
| 3,066,910 | 12/1962 | Bluck | 416/96 R |
| 4,012,167 | 3/1977 | Noble | 415/115 |
| 4,134,709 | 1/1979 | Eskesen | 416/96 R |
| 4,353,679 | 10/1982 | Hauser | 415/115 |
| 5,320,485 | 6/1994 | Bourguignon et al. | 415/115 |
| 5,413,458 | 5/1995 | Calderbank | 415/115 |
| 5,464,322 | 11/1995 | Cunha et al. | 415/115 |
| 5,536,143 | 7/1996 | Jacala et al. | 416/96 R |
| 5,591,002 | 1/1997 | Cunha et al. . | |
| 5,634,766 | 6/1997 | Cunha et al. . | |
| 5,758,487 | 6/1998 | Salt et al. | 60/39.75 |
| 5,813,835 | 9/1998 | Corsmeier et al. | 416/97 R |
| 5,848,876 | 12/1998 | Tomita | 416/96 R |

FOREIGN PATENT DOCUMENTS

| | | | |
|---|---|---|---|
| 2-11801 | 1/1990 | Japan | 416/97 R |
| 4-124405 | 4/1992 | Japan | 416/95 |
| 2 307 520 | 5/1997 | United Kingdom . | |

*Primary Examiner*—Christopher Verdier
*Attorney, Agent, or Firm*—Alston & Bird LLP

[57] ABSTRACT

In the cooling system for the gas turbine blade, the apparatus of the present disclosure ensures cooling of the trailing edge part of the blade for which machining is difficult, while aiming at improvement of the thermal efficiency. The steam cooling structure for carrying out heat recovery-type steam cooling is employed to the leading edge part and the central part of the blade where machining is easy because of its large thickness, and the convection cooling end film cooling are employed for the trailing edge part of the blade where the thickness is small, using steam cooling and air cooling at the same time.

4 Claims, 3 Drawing Sheets

GAS TURBINE BLADE

FIELD OF THE INVENTION AND RELATED ART STATEMENT

The present invention relates to a gas turbine blade which is cooled by concurrently using two types of coolants, i.e., steam and discharged air from a compressor.

Cooled blades which are used in a high-temperature gas turbine have a passage of cooling air in the interior of the blades. The blades are cooled by low-temperature air flowing through the passage in the blade, and the temperature of the blade is suppressed to a tolerable temperature level which is lower than the temperature of the combustion gas.

In the conventional air-cooling system, as shown in the vertical sectional view of FIG. 4(*a*) and in the sectional view along the line B-B of FIG. 4(*b*), the cooling air supplied to the blade passes through the internal cooling passage from the root part of the blade to the inner part of the blade and is discharged into the main gas stream as a unidirectional flow from the holes in the blade which open toward the main stream.

Since there is an upper limit of thermal efficiency in the conventional system, the use of steam in place of air has been proposed in recent years for further improving the thermal efficiency of the conventional system.

When the steam cooling is adopted, the steam is not discharged into the main stream but is recovered, and heat is recovered from this recovered steam by collecting the heat gained by cooling the gas turbines with the use of a steam turbine. The overall efficiency of the plant may be maintained and the turbine efficiency can be improved by reducing the amount of cooling medium blowing out into the gas turbine.

When the steam is recovered by the steam turbine, a reduction of efficiency can be minimized if pressure losses caused by the cooling of gas turbine may be reduced and the heat is recovered at a higher pressure stage of the steam turbine.

However, as may be readily understood from FIG. 4 which shows an example of air cooling, the trailing edge part of a moving blade in a gas turbine is made thin so as to reduce aerodynamic losses. It would be difficult to provide convection cooling structures such as serpentine cooling or impinging cooling in the interior of this thin part.

OBJECT AND SUMMARY OF THE INVENTION

The object of the present invention is to provide a gas turbine blade which does not have problems related to machining of the trailing end part of the thin blade while considering improvement of the heat efficiency.

The present invention has been devised to solve the above-mentioned problems and provides a gas turbine moving blade which comprises a blade part, a platform part, a root part, a steam cooling structure provided in the leading edge part and in the central part of the blade for heat recovery-type steam cooling, and a convection and film cooling structure which introduces air discharged from compressor to the trailing edge of the blade. That is, for the leading edge and central parts at which the blade thickness is large, steam for cooling is supplied into such a cooling passage as a serpentine flow passage, and heat is recovered. On the one hand, for the trailing edge part where the thickness of the blade is small, the air discharged from the compressor is introduced as cooling air from a cooling passage inlet port which is provided at the shank part and the like of the blade, then convection cooling and subsequent film cooling are performed. Adopting such cooling structure with a combination of air and steam cooling, the effective cooling is achieved without facing difficulties in machining.

According to the present invention, steam is used for cooling the leading edge part and the central part of the blade, and after having cooled; the blade below the tolerable temperature level, the heat absorbed by the steam resulting from the cooling is recovered by the steam turbine. Further, air is additionally used for cooling the trailing edge part of the blade. The present invention can enhance the performance, reliability, and yield of the plant as a whole.

BRIEF DESCRIPTION OF THE DRAWINGS

An embodiment according to the present invention will be described in further detail with reference to the accompanying drawings, in which.

DETAILED DESCRIPTION OF THE PREFERRED EMBODIMENTS

Figure 1:
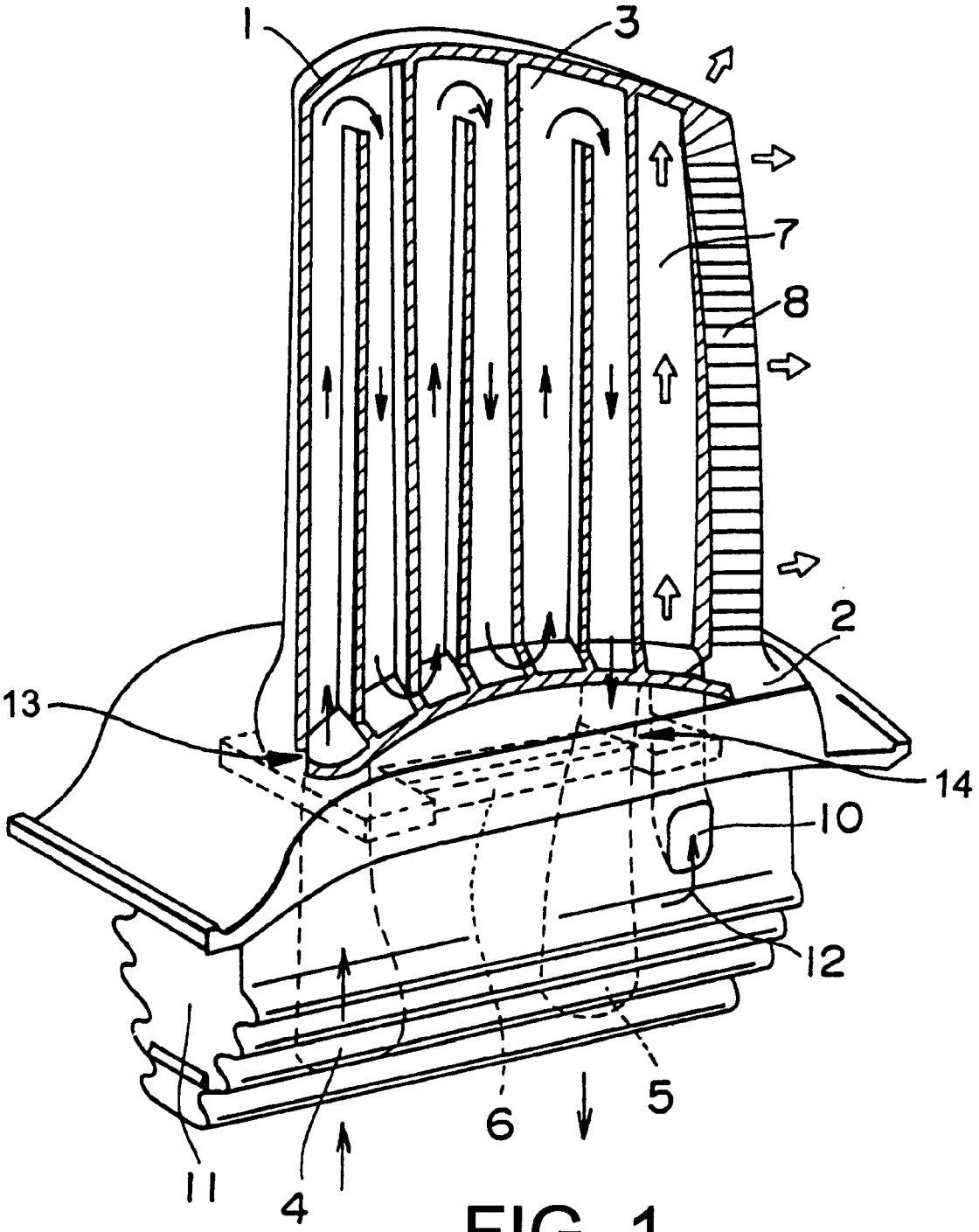
FIG. 1 is a sectional view showing the cooling structure of the gas turbine blade part, according to one embodiment of the present invention.
Figure 2:
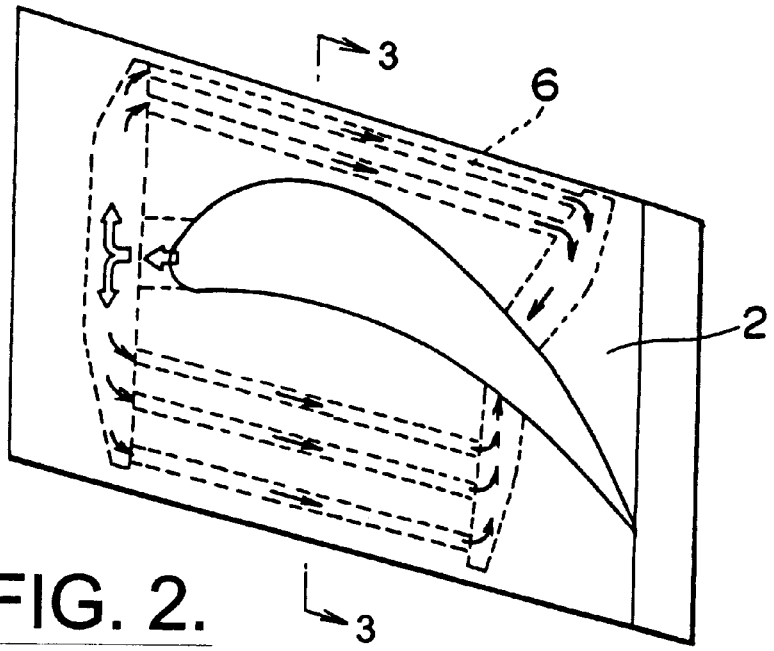
FIG. 2 is a plan view showing the cooling structure of the platform of the gas turbine blade of FIG. 1.
Figure 3:
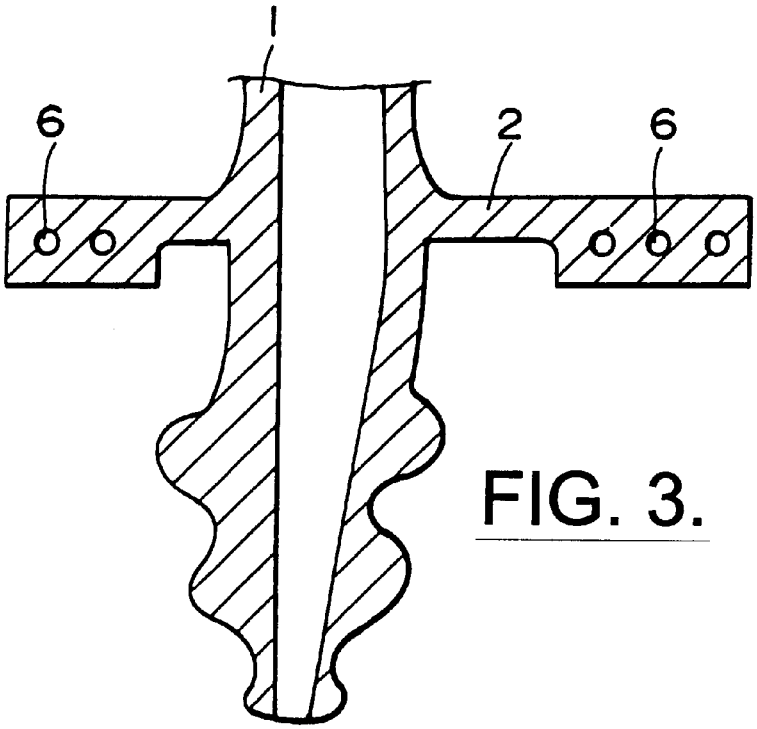
FIG. 3 is a sectional view, along the line A—A of FIG. 2.
Figure 4B:
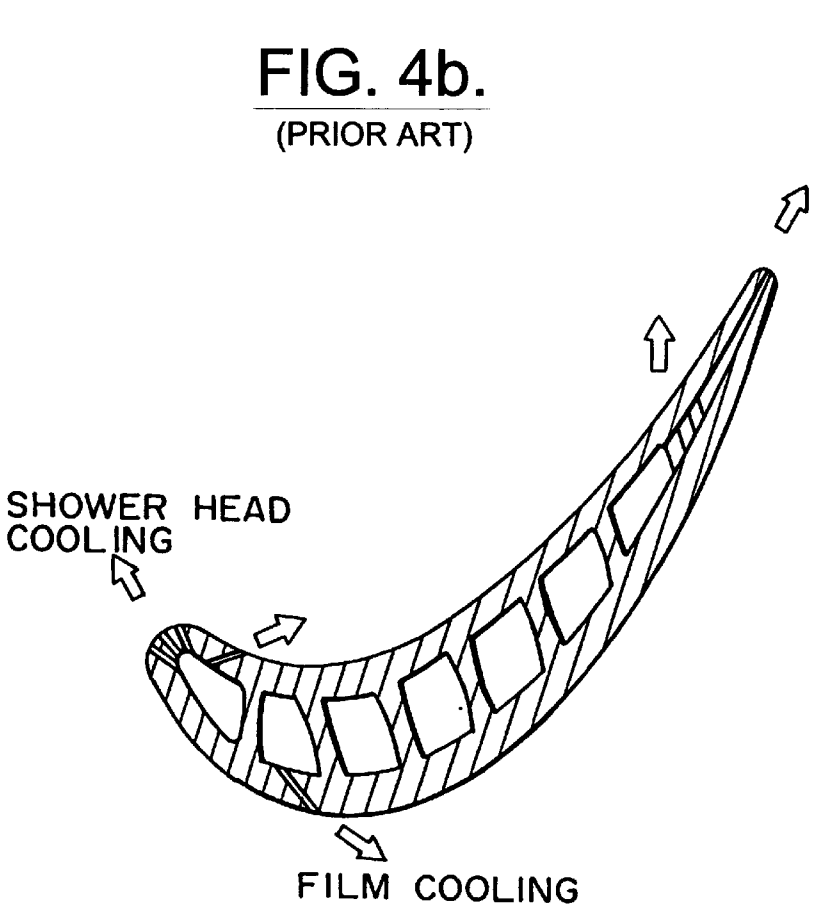
FIG. 4b. (PRIOR ART)
FIG. 4 shows the conventional blade cooling structure, and FIG. 4(*a*) is a vertical sectional view and FIG. 4(*b*)is a sectional view, along the line B—B of FIG. 4(*a*).
Figure 4A:
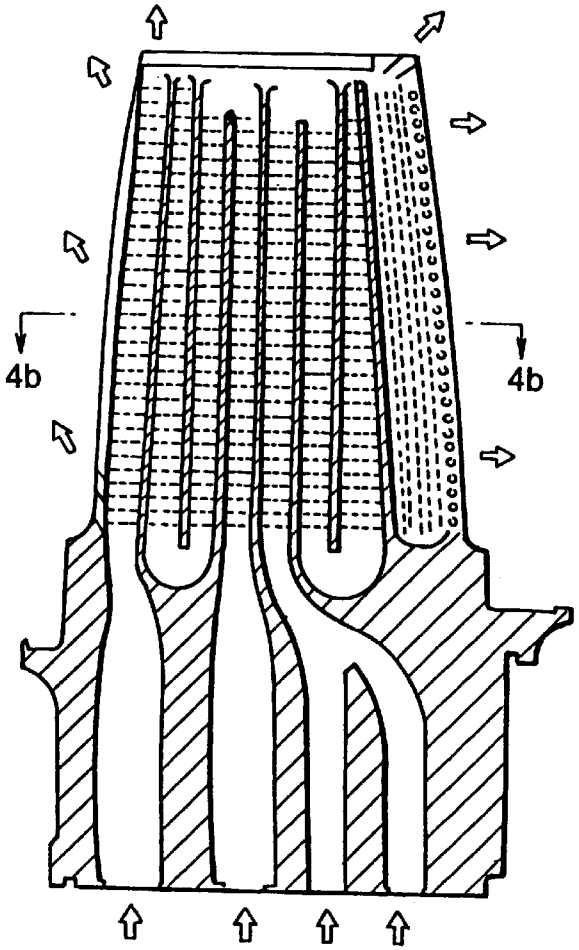
FIG. 4a. (PRIOR ART)

An embodiment of the present invention will be described, with reference to FIG. 1 to FIG. 3. FIG. 1 shows a vertical sectional view of the gas turbine blade; FIG. 2 shows the cooling structure of the platform; and FIG. 3 shows a sectional view of the platform convection cooling holes.

In the figures, a blade part 1, a platform 2, a cooling serpentine passage 3 formed over the leading edge part to the central part of the blade, a supply port 4 for the cooling steam, a recovery port 5 for the cooling steam, a multi-hole type cooling passage 6 provided on platform 2, a cooling air passage 7 provided in the trailing edge part of the blade, a convection cooling hole 8 provided in the trailing part of the blade continuing from the cooling air passage 7 of the trailing part of the blade, a cooling air passage entrance 10, a root part 11 of the blade, and an arrow 12 showing the inflow of the discharged air from a compressor are shown. The supply port 4 for the cooling steam and the recovery port 5 for the cooling steam are provided in the root part 11 of the blade and are in communication with the cooling serpentine passage 3. A steam supply port 13 in an upstream portion of the platform 2 is in fluid communication with the serpentine passage 3 for supplying steam thereto, and a steam receiving port 14 in a downstream portion of the platform 2 is in fluid communication with the serpentine passage 3 for receiving steam therefrom.

In the embodiment having the above constitution, the blade-cooling steam is supplied from a rotor system via the supply port 4 for the cooling steam of the root part 11 of blade. Further, this blade-cooling steam, after cooling by flowing through the internal cooling serpentine passage 3 in the blade 1 along the arrow, is recovered from the recovery port 5 for the cooling steam in the root part 11 of the blade to the rotor system.

At the same time, the platform 2 has a branched flow of steam on the downstream side from the supply port 4 for the cooling steam. After having performed convection cooling with the steam flowing in the multi-hole convection cooling passage 6, the branched flow of steam is mixed with the blade cooling steam on the upstream side of the recovery port 5 for the cooling steam and is then recovered.

On the one hand, in the trailing edge part of the blade, the air 12 discharged from compressor is supplied from the cooling air passage entrance 10, and the air 12 passes through the cooling air passage 7. After performing cooling through the convection cooling hole 8 in the trailing edge part of the blade, the air 12 is discharged into the main stream.

According to the present embodiment, cooling steam supplied from the rotor system is used to cool the platform 2 as well as the leading edge part and the central part of the blade part 1 while it leads into the internal convection cooling passage and flows through the multi-hole cooling passage 6 and the serpentine passage 3. After having been steam cooled by means of the serpentine passage 3 and the multi-hole type cooling passage 6, the cooling steam is again returned to the rotor system, together with the heat which has been removed as a result of cooling. The collected heat is then recovered outside the blade system.

The heat gained by the steam after cooling the blade is recovered by a steam turbine (not shown). The performance of the gas turbine is prevented from deteriorating, and an improvement in the gas turbine efficiency can be achieved by not allowing the coolant enter into the gas turbine. The efficiency of the plant as a whole can be enhanced in combination with these effects.

In addition, with regard to the trailing edge part of the blade, the air 12 discharged from compressor is led to the cooling air passage entrance 10 which is provided at a shank part and led through the cooling air passage 7 extending from the blade root to the blade end. The air 12 passes through the convection cooling holes 8 provided in the trailing edge part of the blade and the film cooling holes provided on the blade surface to perform cooling. Since this cooling air passage 7 and the convection cooling holes 8, unlike the serpentine passage 3, do not amount to a large volume, it is not difficult to fabricate such passage and holes. The temperature of the metal can be suppressed below the tolerable temperature level by the film cooling.

Although the present invention has been described with reference to an embodiment illustrated as in the foregoing sections, it is obvious that the present invention is not limited to such an embodiment, but a variety of modifications may be added to its specific structure, within the range of the present invention.

What is claimed is:

1. A moving gas turbine blade combination comprising:

a blade part, a platform part, a root part, a steam cooling structure for performing thermal recovery-type steam cooling of a leading edge part and a central part of the blade part with steam; and an air cooling structure for introducing cooling air into the blade part for performing convection cooling and film cooling of a trailing edge part of the blade part, a steam supply port in an upstrean portion of said platform part in fluid communication with said steam cooling structure for supplying steam thereto, and a steam recovery port in a downstream portion of said platform part in fluid communication with said steam cooling structure for receiving steam therefrom;

and a plurality of cooling passages in said platform part, each of said passages being fluidly connected at a first end thereof to said steam supply port, and each of said passages additionally being fluidly connected at a second end thereof to said steam recovery part, whereby said passages transfer steam through said platform part for cooling thereof.

2. The gas turbine blade combination according to claim 1, wherein the steam cooling structure comprises a serpentine cooling passage for supplying the cooling steam in the leading edge part and the central part of the blade part, and the air cooling structure comprises a cooling air passage for introducing the cooling air into the trailing edge part of the blade part and holes provided in a wall of the blade part so as to let the air flow from the cooling air passage to the outside of the blade part.

3. The gas turbine blade combination according to claim 1, wherein inlets for said cooling steam and said air are provided in said root part.

4. A method of cooling a moving blade of a gas turbine, comprising:

delivering a stream of cooling steam into a serpentine steam cooling passage via an inlet portion thereof located at an inner end of the blade in the leading edge portion thereof, which extends through a leading edge portion and a central portion of the blade for steam cooling the leading edge and central portions, and recovering steam which has flowed through the steam cooling passage via an outlet portion of the serpentine passage located at the inner end of the blade at a central portion thereof;

supplying a stream of cooling air into an air cooling passage which extends through a trailing edge portion of the blade for air cooling the trailing edge portion, and discharging air from the air cooling passage into a main gas flowpath of the gas turbine via film cooling holes in the trailing edge portion; and diverting a portion of the cooling steam being delivered into the steam cooling passage and supplying said diverted portion thereof through a plurality of cooling passages in a platform at an inner end of the blade for steam cooling the platform, and recovering steam from said passages and combining said recovered steam with said steam recovered from said outlet portion of said serpentine passage.

* * * * *

UNITED STATES PATENT AND TRADEMARK OFFICE

CERTIFICATE OF CORRECTION

PATENT NO. : 6,079,946
DATED : June 27, 2000
INVENTOR(S) : Suenaga et al.

It is certified that error appears in the above-identified patent and that said Letters Patent is hereby corrected as shown below:

Title page, [57] Abstract,
Line 8, "end" should read --and--.

Column 2,
Line 7, after "cooled" cancel the semicolon (;).

Column 4,
Line 14, "part" should read --port--.

Signed and Sealed this

Tenth Day of July, 2001

Nicholas P. Godici

*Attest:*

*Attesting Officer*

NICHOLAS P. GODICI
*Acting Director of the United States Patent and Trademark Office*